US006544096B1

(12) United States Patent
Pyrce et al.

(10) Patent No.: US 6,544,096 B1
(45) Date of Patent: Apr. 8, 2003

(54) TOY LANTERN

(75) Inventors: Philip R. Pyrce, Amherst, NY (US); David DuBois, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/855,037

(22) Filed: May 15, 2001

(51) Int. Cl.[7] ..... A63H 3/00

(52) U.S. Cl. ..... 446/268; 446/71; 446/175; 206/541

(58) Field of Search ..... 446/71, 75–77, 446/304, 268, 479, 484, 481, 491, 485, 85, 296; 362/190, 191, 186, 253; 431/156, 344; 126/255, 258, 260, 256; 206/541, 542, 546

(56) References Cited

U.S. PATENT DOCUMENTS

| | | | | | |
|---|---|---|---|---|---|
| 32,643 | A | * | 6/1861 | Parr | 206/541 |
| 33,730 | A | | 11/1861 | Ames | |
| 485,008 | A | * | 10/1892 | House | 126/260 |
| 520,188 | A | * | 5/1894 | Newsome | 126/260 |
| 692,103 | A | * | 1/1902 | Bailey | 126/260 |
| 747,010 | A | * | 12/1903 | Smith | 126/260 |
| 1,357,426 | A | * | 11/1920 | Savitsky | 126/256 |
| 1,372,325 | A | | 3/1921 | Willemin | |
| 1,809,596 | A | | 6/1931 | Nason | |
| 2,101,281 | A | | 12/1937 | Porter | |
| 2,180,561 | A | | 11/1939 | Stevens | |
| 3,144,016 | A | | 8/1964 | Basci | |
| 3,868,177 | A | | 2/1975 | Glass et al. | |
| 4,004,132 | A | | 1/1977 | Glass et al. | |
| 4,646,213 | A | * | 2/1987 | Fanelli et al. | 126/47 |
| D318,600 | S | | 7/1991 | Lillelund et al. | |
| 5,056,424 | A | | 10/1991 | Lai | |
| 5,197,623 | A | | 3/1993 | Wang | |
| 5,417,200 | A | * | 5/1995 | Wasielewski | |
| D396,891 | S | | 8/1998 | Lam | |

* cited by examiner

*Primary Examiner*—Derris H. Banks
*Assistant Examiner*—Bena B. Miller
(74) *Attorney, Agent, or Firm*—Cooley Godward LLP

(57) ABSTRACT

A camping toy having an assembly with a coupled configuration and an expanded configuration. The assembly defines a toy lantern when the assembly is in the coupled configuration, and the assembly defines a plurality of separated toy camping items when the assembly is in the expanded configuration. The plurality of toy camping items include a light and a toy canteen, a toy stove, and/or a toy cooking pan.

29 Claims, 4 Drawing Sheets

TOY LANTERN

BACKGROUND OF THE INVENTION

1. Field of the Invention

The present invention relates to toys and, more particularly, to a toy lantern at least partially defined by a plurality of separate toy camping items.

2. Description of the Related Art

Children have a particular fascination with camping activities and camping gear. Some conventional toys resemble individual items of camping gear, such as toy lanterns. However, these conventional toys are configured for a single purpose and often fail to keep the interest of children. It is thus apparent that a need exists for camping toys that foster learning to keep a child's interest and encourage creativity.

SUMMARY OF THE INVENTION

Generally speaking, the embodiments of the present invention provide a toy lantern that may be disassembled into separate toy camping items so as to increase a child's interest in the toy and encourage creativity.

Other advantages and features associated with the present invention will become more readily apparent to those skilled in the art from the following detailed description. As will be realized, the invention is capable of other and different embodiments, and its several details are capable of modification in various obvious aspects, all without departing from the invention. Accordingly, the drawings and the description are to be regarded as illustrative in nature, and not limitative.

DETAILED DESCRIPTION OF THE PREFERRED EMBODIMENTS

Figure 1:
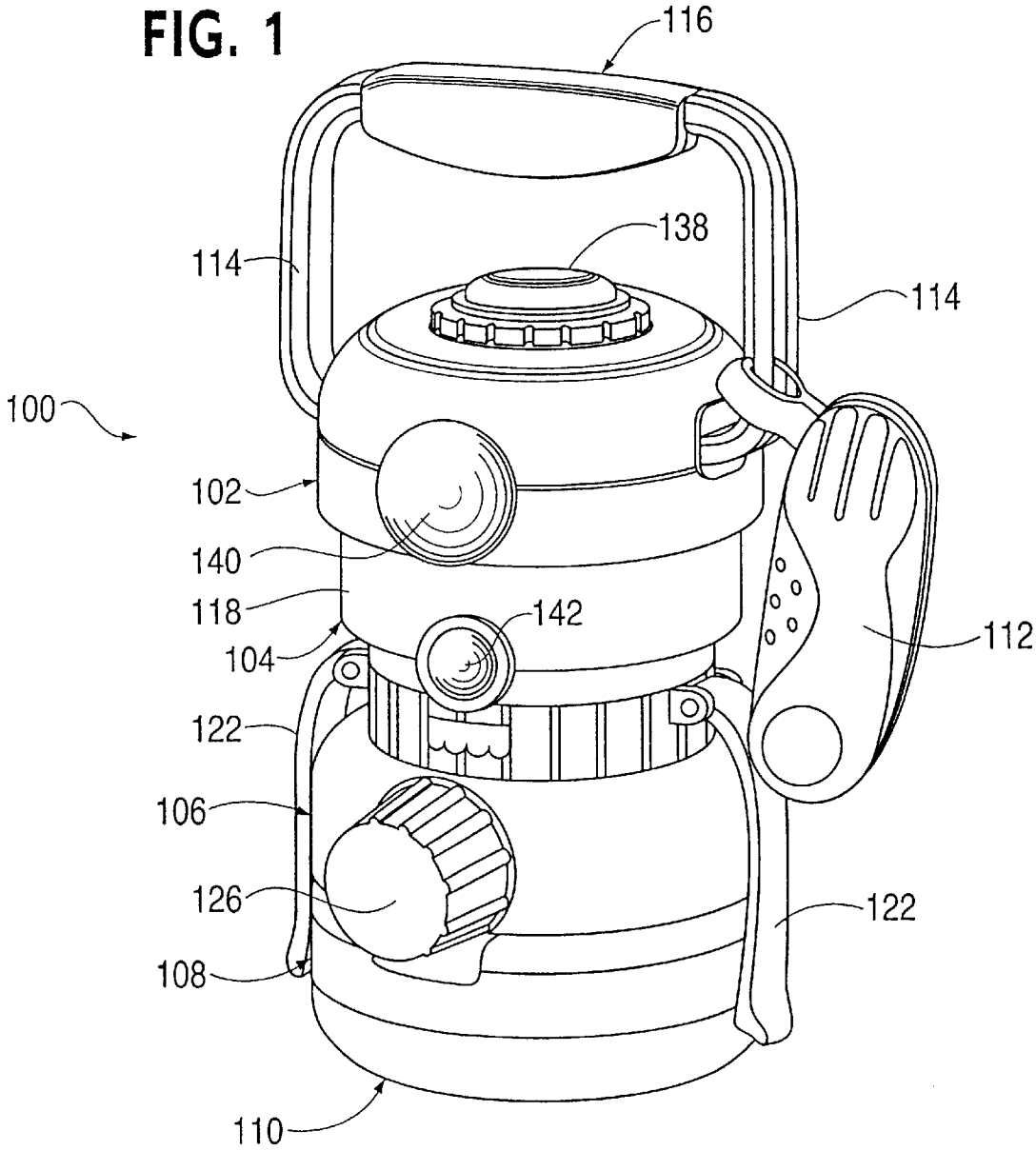
FIG. 1 is a perspective view of a toy lantern in accordance with one embodiment of the present invention.
Figure 2:
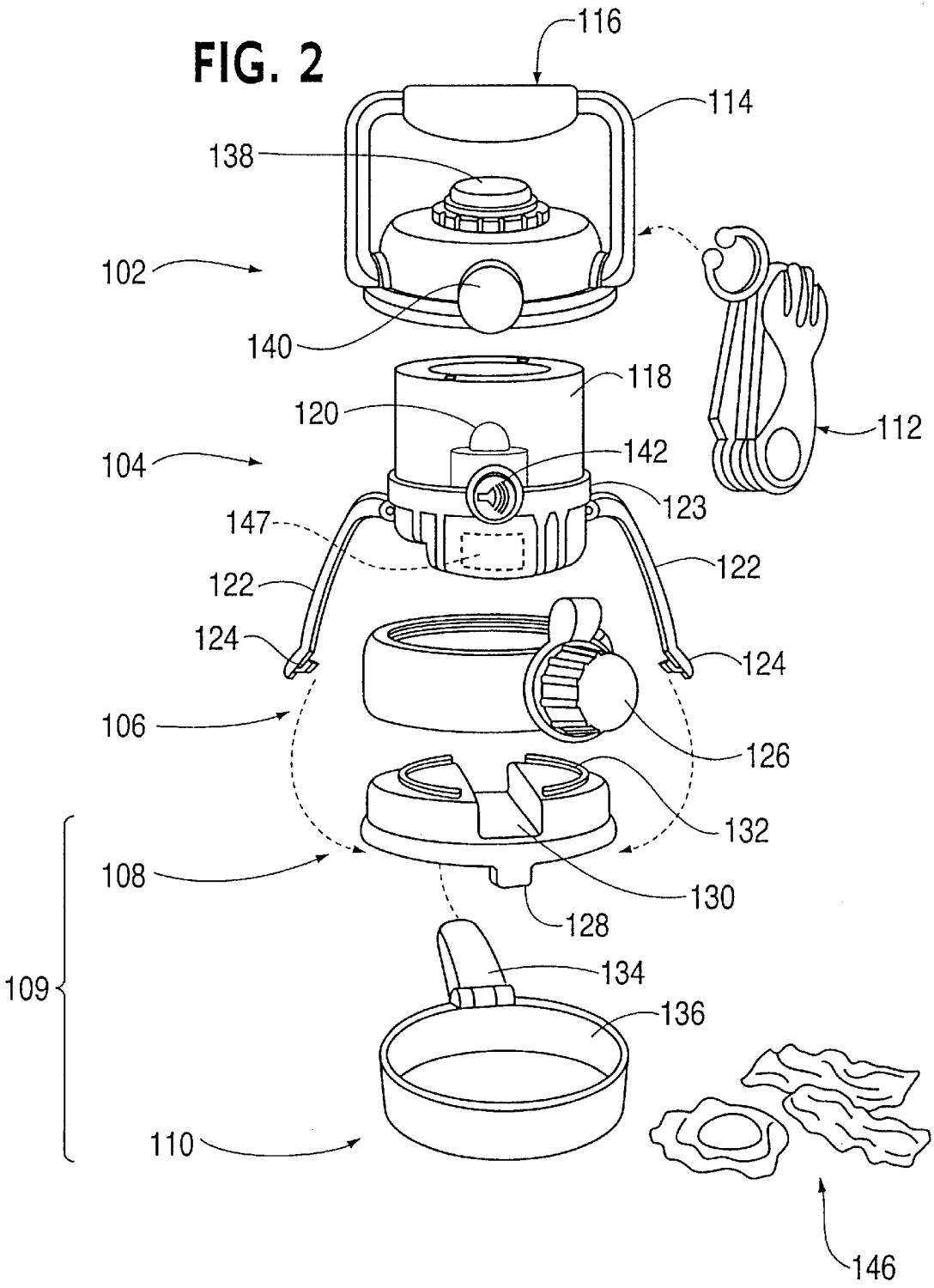
FIG. 2 is an exploded view of the toy lantern illustrated in FIG. 1, where the toy lantern has been separated into a number of toy camping items, including a toy stove, a light, a toy canteen, a toy plate, and a toy cooking pan.

FIGS. 1–5 illustrate one embodiment of a toy lantern 100 in accordance with the present invention. The toy lantern 100 is essentially a portable enclosure having a transparent or translucent side that holds a light source 120, such as a light bulb or a light emitting diode. As illustrated in FIG. 2, the toy lantern 100 is at least partially defined by two or more separate items of toy camping equipment 102, 104, 106, 108, 110 coaxially arranged with respect to one another. In the preferred embodiment, each item of toy camping equipment 102, 104, 106, 108, 110 is fabricated from plastic. When the toy lantern 100 is disassembled to the expanded configuration illustrated in FIG. 3, a child may play with each item of toy camping equipment 102, 104, 106, 108, 110.

In the illustrated embodiment, the toy camping equipment includes a toy stove 102, a light 104, a toy canteen 106, a toy plate 108, and a toy cooking pan 1I0. When the toy lantern 100 is in the assembled configuration illustrated in FIG. 1, the toy stove 102, light 104, toy canteen 106, toy plate 108, and toy cooking pan 110 define the toy lantern 100. Each item of toy camping equipment 102, 104, 106, 108, 110 is detachably coupled, i.e., removably joined or connected, to one or more other items of camping equipment. The items of the toy camping equipment 102, 104, 106, 108, 110 may thus be coupled to assemble and define at least a portion of the toy lantern 100, and may also be decoupled to disassemble the toy lantern 100 and define the separate items of toy camping equipment for further use by a child.

Figure 3:
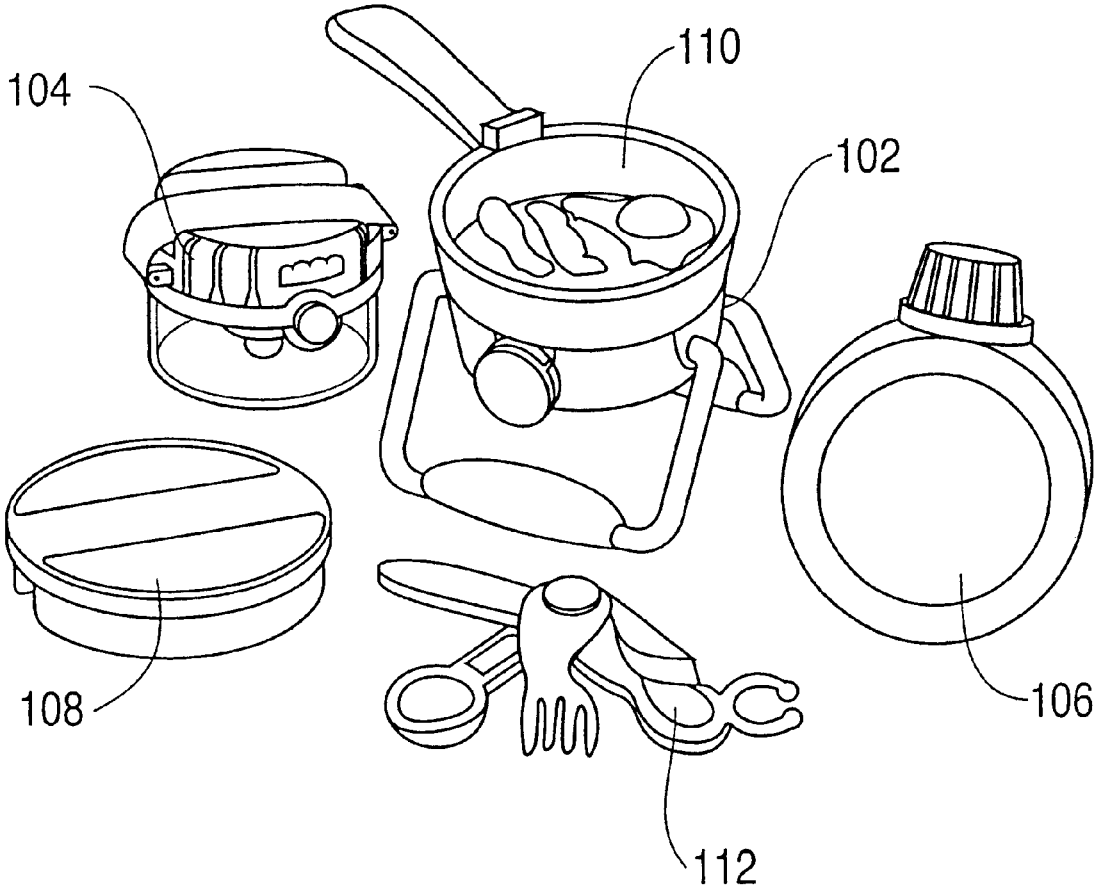
FIG. 3 is a perspective view of the toy camping items that define the toy lantern illustrated in FIG. 1.
Figure 4:
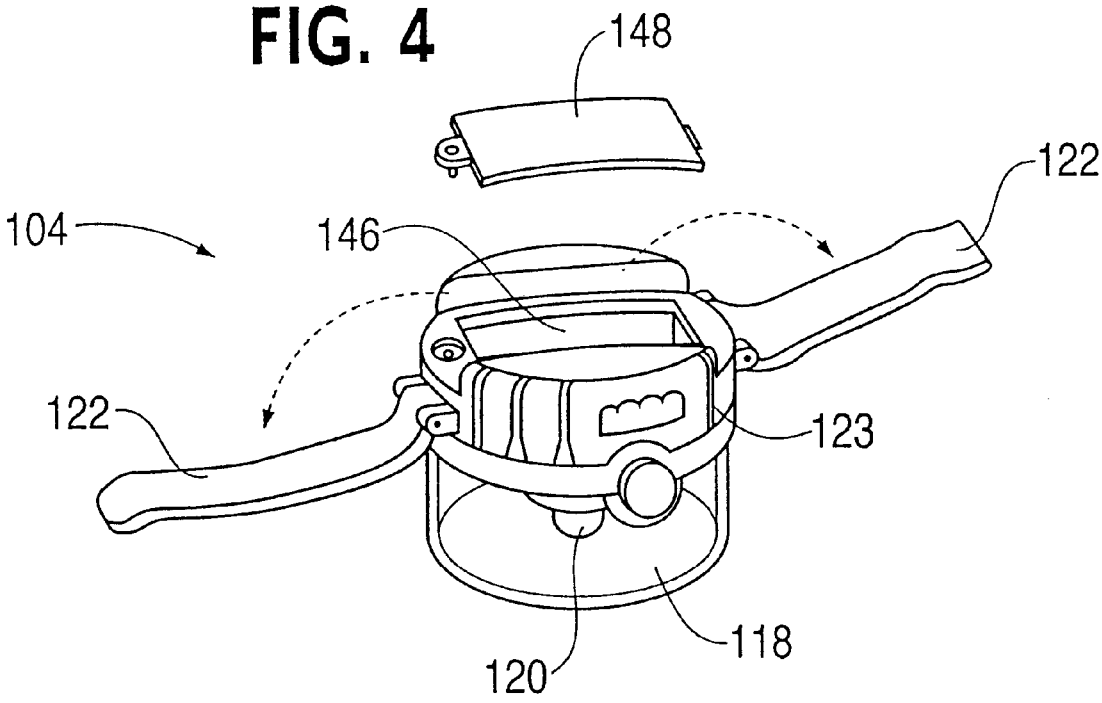
FIG. 4 is a perspective view of the light of the toy lantern illustrated in FIG. 1.
Figure 5:
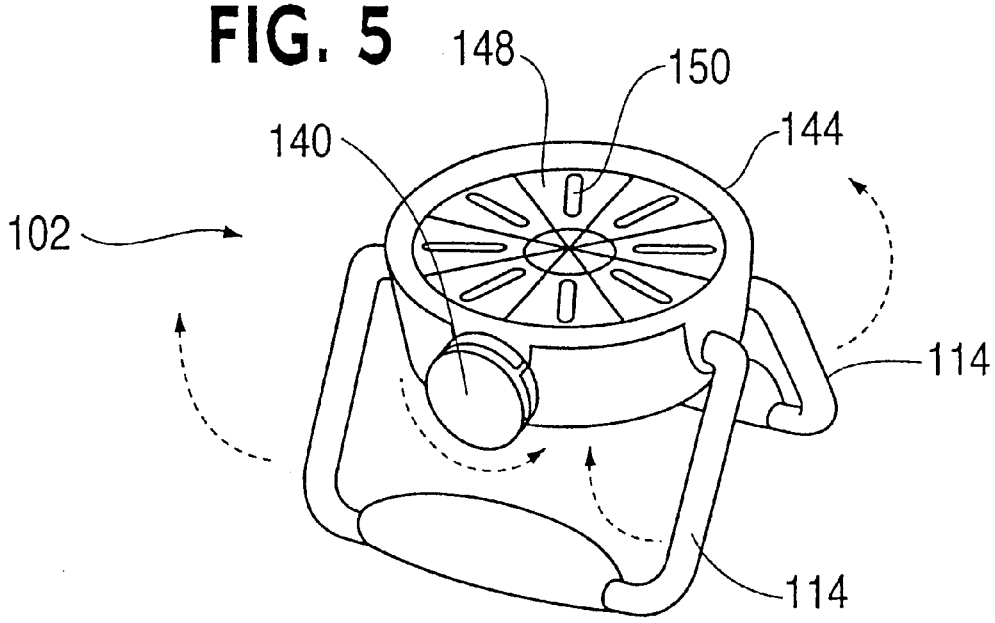
FIG. 5 is a perspective view of the toy stove of the toy lantern illustrated in FIG. 1.

As illustrated in FIG. 1, the toy stove 102 defines the top or uppermost portion of the toy lantern 100 when the toy lantern is assembled. FIGS. 2, 3, and 5 illustrate the toy stove 102 after it has been decoupled from the remainder of the toy lantern 100, preferably from the light 104. The toy stove 102 includes two legs 114 that are pivotally attached to a body 144 of the stove. The body 144 includes a recess 148 that simulates a toy cooking area having openings 150 exposing simulated flames or embers. A child may rotate an adjustment knob 140 to increase or decrease the amount of simulated flames or members exposed by the openings 150. To couple the toy stove 102 and the light 104 to each other, the legs of the toy stove are pivoted from the locked position illustrated in FIG. 5 to the position illustrated in FIGS. 1 and 2, where the two legs abut each other to define a handle 116 of the toy lantern 100. Hence, the legs 114 support the body 144 of the toy stove when decoupled from the toy lantern 100 and define the handle 116 of the lantern when the toy stove is coupled to define the toy lantern 100. In the illustrated embodiment, each leg 114 is a U-shaped member. However, alternatively shaped legs are also contemplated. For example, the legs 114 may be L-shaped members that are pivotally attached to the body 144 at one location.

The toy stove 102 and the light 104 are coupled to each other by inserting the top portion of the light 104 into the recess 148 of the toy stove 102, where biased arms or pegs (not illustrated) of the toy stove 102 engage a lip or edge on the top portion of the light 104. Once the toy stove 102 and the light 104 are coupled to each other, the toy,stove 102 and the light 104 are joined and are moveable as one item. To decouple the toy stove 102 and the light 104, a release button 138 of the toy stove is depressed, which causes the arms to disengage from the light 104 such that the toy stove 102 and the light 104 are no longer coupled. As will be appreciated, the toy stove 102 and the light 104 may be detachably coupled by any of a variety of mechanisms. For example, the toy stove 102 an the light 104 may be detachably coupled with threads, clasps, hooks, a latch, and/or a press fit.

The light 104 defines the luminous portion of the assembled toy lantern 100. Hence, the light includes the light source 120 and a transparent or translucent globe 118 that houses the light source. The light source 120 is powered by a power supply (not illustrated), such as a battery, which may be housed in a compartment 146 and covered with a lid 148 at the bottom side of the light 104. The light 104 also include a switch (not illustrated) via which the light source 102 may be turned on and off. The preferred embodiment of the light 104 further includes an audio transducer 147, such as a speaker, that outputs audible sound waves in the form of nature sounds. The nature sounds include sounds typically associated with camping environments, such as the sounds of crickets, owls, and frogs. The signals fed to the audio transducer are stored in a storage device, such as a RAM, ROM, buffer, or other memory, and are fed to the audio transducer when a child or other user presses an audio button 142 of the light 104. The pressing of the audio button 142 executes control logic of a programmed microprocessor, which outputs the audio signals from the memory to the audio transducer for a predetermined period of time. After this period of time has elapsed, the signals are no longer fed to the audio transducer until the audio button 142 is pressed again.

As illustrated in FIGS. 1–4, the light 104 further includes two offset arms 122 that are pivotally attached to a casing 123 of the light 104. As illustrated in FIG. 3, when the light 104 is decoupled from the toy lantern 100, the arms 122 may be pivoted into a recess located directly above the compartment 146. As described further below, to assemble the toy lantern 100, the light 104 and a toy mess kit 109 are coupled to each other.

The toy mess kit 109 is a coupled arrangement of the toy plate 108 and the toy cooking pot 110. FIG. 1 illustrates the toy plate 108 and the toy cooking pot 110 coupled together to define the toy mess kit 109. The toy plate 108 is a recessed body for toy food, and includes two latches 128 that may be clasped to the rim of the toy cooking pot 110 so as to cover the toy cooking pot 110. As will be appreciated, the toy plate 108 and the toy cooking pot 110 may be coupled to each other with any variety of mechanisms including those set forth above for the toy stove 102 and light 104. When the toy plate 108 and the toy cooking pot 110 are decoupled, the toy plate 108 may be inverted to the position illustrated in FIG. 3 to serve toy food 146 or otherwise. When the toy cooking pot 110 and the toy plate 108 are decoupled, the toy cooking pot may be placed on the toy stove 102 as illustrated in FIG. 3 to simulate cooking of the toy food 146. The toy cooking pot 110 includes a handle 134 that is pivotally attached to a pan portion 136 of the cooking pot 110. When the toy plate 108 and the toy cooking pot 110 are coupled to each other, the handle 134 of the toy cooking pot may be pivoted into a correspondingly shaped cavity 130 in the bottom side of the toy cooking plate 108. Additionally, the toy food 146 may be stored in the toy cooking pot 110 when the toy plate 108 covers the toy cooking pot 110. When the toy plate 108 and the toy cooking pot 110 are decoupled, the handle 134 may be rotated to a locked or stopped position illustrated in FIGS. 2 and 3. As illustrated in FIG. 1, the bottom of the toy cooking pot 110 defines the base of the toy lantern 100.

The toy mess kit 109 and the light 104 are coupled to each other by rotating the arms 122 of the light toward the toy cooking pot 110 and latching the clasps 124 of the arms over the edge of the toy cooking pot 110 as illustrated in FIGS. 1 and 2. Likewise, the toy mess kit 109 and the light 104 are decoupled from each other by unlatching the clasps 124 from the edge of the toy cooking pot 110. In the illustrated embodiment, the coupling of the light 104 and the toy mess kit 109 also couples the light 104 and the toy canteen 106.

The toy canteen 106 is a hollow flask for carrying water or another item and includes a cap 126 that may be opened and closed for the removal or addition of items to the interior of the toy canteen 106. When the light 104 is coupled to the toy mess kit 109, the toy canteen 108 abuts the bottom surface of the light and the bottom surface of the toy plate so as to be sandwiched between these two items of toy camping equipment. Hence, the coupling of the light 104 and the toy mess kit 109 also couples the toy canteen 106. To maintain the coaxial alignment of the items of the assembled toy lantern 100, the toy canteen 106 includes a top recess that receives a portion of the light 104 and a bottom recess that receives a lip 132 on the bottom surface of the toy cooking plate.

To complete the assembly of the toy lantern 100, the camping items 102, 104, 106, 108, 110 are coupled to each other in the above described manner. For example: the toy cooking plate 108 and the toy cooking pot 10 are first coupled to each other; the light 104, the toy mess kit 109, and the toy canteen 106 are then coupled to each other; and, lastly, the toy stove 102 and the light 104 are coupled to each other. As is also illustrated in FIG. 1, one or more camping accessories, such as a toy camping knife 112, may be coupled to the toy lantern 100. To disassemble the lantern 100 into the items of camping equipment, the stove 102, the light 104, the toy canteen, and the toy mess kit 109 are be decoupled from each other. A child may then decouple the toy mess kit 109 to play with the toy cooking pot 110, the toy cooking plate 108, the toy canteen 106, the toy stove 102, and the light 104. As will be appreciated, the order or coupling and decoupling of the items of toy camping equipment can vary.

Although preferred that the toy lantern include the toy camping items described below, it will be appreciated that the toy lantern need not include each of the items 102, 106, 108, 110. For example, in an alternative embodiment, the toy lantern may be defined solely by the toy stove 102 and the light 104, or solely by the canteen 106 and the light 104. It will also be appreciated that the assembled toy lantern may also be defined by additional items of camping equipment, such as a toy tent.

The principles, preferred embodiments, and modes of operation of the present invention have been described in the foregoing description. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. A camping toy comprising:

an assembly having a coupled configuration and an expanded configuration, said assembly defining a toy lantern when said assembly is in said coupled configuration, said assembly defining a plurality of separated toy camping items when said assembly is in said expanded configuration, said plurality of toy camping items including an electric light unit and at least one of a toy canteen, a toy stove, and a toy cooking pan.

2. The camping toy of claim 1, said plurality of toy camping items including said toy stove, said toy stove including at least two legs for supporting a toy cooking area of said stove when said assembly is in said expanded configuration, said legs defining a handle of said toy lantern when said assembly is in said coupled configuration.

3. The camping toy of claim 1, said plurality of toy camping items including said toy cooking pan, said toy cooking pan defining a base of said lantern when said assembly is in said coupled configuration.

4. The camping toy of claim 1, said plurality of toy camping items including said toy canteen.

5. The camping toy of claim 1, said plurality of toy camping items including a toy plate.

6. The camping toy of claim 1, said plurality of toy camping items including said toy canteen, said toy stove, and said toy cooking pan.

7. The camping toy of claim 6, said toy canteen and said electric light unit being located between said toy stove and said toy cooking pan when said assembly is in said coupled configuration.

8. The camping toy of claim 6, a toy plate being coupled to said toy cooking pan when said assembly is in said coupled configuration.

9. The camping toy of claim 6, said toy canteen abutting said electric light unit and a toy plate when said assembly is in said coupled configuration.

10. The camping toy of claim 6, said toy stove being coupled to said electric light unit when said assembly is in said coupled configuration.

11. The camping toy of claim 1, said electric light unit including a globe and a light source located within said globe.

12. The camping toy of claim 1, said electric light unit including at least two arms that couple to at least one of said plurality of camping items.

13. The camping toy of claim 1, said electric light unit including means for emitting nature sounds.

14. The camping toy of claim 1, further comprising a toy pocket knife coupleable to said assembly.

15. A camping toy comprising:

a first piece of toy camping equipment;

a second piece of toy camping equipment; and a third piece of toy camping equipment, said first piece of toy camping equipment, said second piece of toy camping equipment, and said third piece of toy camping equipment being coupleable to form a toy lantern, at least one of said first piece of toy camping equipment, said second piece of toy camping equipment and said third piece of toy camping equipment being an electric light unit.

16. A toy lantern comprising:

a toy mess kit;

an electric light unit having a transparent globe and a light source located within said globe; and a toy stove having two legs, said light being detachably coupled to said toy stove and detachably coupled to said toy mess kit with said light being coaxially located between said toy mess kit and said toy stove, said toy stove defining a top portion of said toy lantern, said two legs defining a handle of said toy lantern, said toy mess kit defining a bottom portion of said toy lantern, and said electric light unit defining a luminous portion of said toy lantern.

17. The toy lantern of claim 16, said toy mess kit including a toy cooking pan with a pivotable handle.

18. The toy lantern of claim 17, said toy mess kit including a toy plate coupled to said toy cooking pan to define a cover for said cooking pan.

19. The toy lantern of claim 16, said toy mess kit including toy food, said toy food being located in said toy cooking pan.

20. The toy lantern of claim 16, further comprising a toy canteen abutting said electric light unit and said toy mess kit, and located coaxially between said toy mess kit and said electric light unit.

21. The toy lantern of claim 20, said toy canteen including a first recess that receives a portion of said electric light unit and a second recess that receives a portion of said toy mess kit.

22. The toy lantern of claim 16, said electric light unit having at least two arms coupled to said toy mess kit.

23. A method comprising:

coupling a plurality of toy camping items to each other to define a toy lantern, the plurality of toy camping items including a toy stove and an electric light unit.

24. The method of claim 23, further comprising rotating two legs of the toy stove to a position where the legs abut each other to define a handle of the toy lantern.

25. The method of claim 23, said coupling including:

coupling a toy mess kit and the electric light unit.

26. The method of claim 25, said coupling the toy mess kit and the electric light unit including latching two arms of the electric light unit to the toy mess kit.

27. A camping toy comprising:

a toy stove;

a toy canteen;

a toy cooking pan; and an electric light unit, said toy stove, said toy canteen, said toy cooking stove, and said electric light unit being coupleable to form a toy lantern.

28. A method comprising:

coupling a plurality of toy camping items to each other to define a toy lantern, the plurality of toy camping items including a toy mess kit and an electric light unit.

29. The method of claim 28, said coupling including:

coupling a toy stove and the electric light unit; and latching two arms of the electric light unit to the toy mess kit.

* * * * *